US005358014A

United States Patent [19]

Kovar

[11] Patent Number: 5,358,014

[45] Date of Patent: Oct. 25, 1994

[54] THREE LAYER PAPER MAKING DRAINAGE FABRIC

[75] Inventor: Walter Kovar, Vienna, Austria

[73] Assignee: Hutter & Schrantz AG, Vienna, Austria

[21] Appl. No.: 941,426

[22] PCT Filed: Apr. 23, 1991

[86] PCT No.: PCT/AT91/00060

§ 371 Date: Oct. 20, 1992

§ 102(e) Date: Oct. 20, 1992

[87] PCT Pub. No.: WO91/17292

PCT Pub. Date: Nov. 14, 1991

[30] Foreign Application Priority Data

May 8, 1990 [AT] Austria ..... 1037/90

[51] Int. Cl.[5] ..... D03D 13/00; D03D 15/00; D03D 11/00

[52] U.S. Cl. ..... 139/383 A; 439/411

[58] Field of Search ..... 139/383 A, 411, 425

[56] References Cited

U.S. PATENT DOCUMENTS

| | | | |
|---|---|---|---|
| 2,854,032 | 9/1958 | Santos | 139/411 |
| 3,885,603 | 5/1975 | Slaughter | 139/383 A |
| 4,327,779 | 5/1982 | Westhead | 139/411 X |
| 4,356,225 | 10/1982 | Dufour | 139/383 A |
| 4,379,735 | 4/1983 | MacBean | 139/411 X |
| 4,438,788 | 3/1984 | Harwood | 139/383 A |
| 4,515,853 | 5/1985 | Borel | 139/383 A |
| 4,537,816 | 8/1985 | Booth et al. | 139/383 A |
| 4,554,953 | 11/1985 | Borel et al. | 139/383 A |
| 4,605,585 | 8/1986 | Bugge | 139/383 A |
| 4,611,639 | 9/1986 | Bugge | 139/411 X |
| 4,941,514 | 7/1990 | Taipale | 139/383 A |
| 5,199,467 | 4/1993 | Lee | 139/383 A |

FOREIGN PATENT DOCUMENTS

| | | | |
|---|---|---|---|
| 386026 | 6/1988 | Austria | 139/383 A |
| 0245851 | 5/1987 | European Pat. Off. | 139/383 A |

*Primary Examiner*—Andrew M. Falik
*Attorney, Agent, or Firm*—Herbert Dubno

[57] ABSTRACT

A fabric of synthetic monofilaments for making a draining wire in a paper machine includes a plurality of warp threads an three layers of weft threads. Each four weft threads of the top layer, two weft threads of the middle layer and all weft thread of the bottom layer form a respective group characterized by warp threads running through the two top layer and the other warp threads running through all three layers.

4 Claims, 2 Drawing Sheets

| | 01 | 02 | 03 | 04 | 05 | 06 | 07 | 08 | 09 | 10 | 11 | 12 | 13 | 14 |
|---|---|---|---|---|---|---|---|---|---|---|---|---|---|---|
| 1 | | | | X | | X | | | | | X | | X | |
| 2 | X | X | | X | | X | X | X | X | | X | | X | |
| 3 | | X | | | | X | | | X | | | | X | |
| 4 | | X | | X | | | | | X | | X | | | |
| 5 | X | X | X | X | X | X | X | X | X | | X | | X | X |
| 6 | | X | | X | X | | X | | X | | X | | | X |
| 7 | | | | X | | | X | | | | X | | | X |
| 8 | | X | | | | | X | | X | | | | | X |
| 9 | | X | X | X | X | | X | | X | | X | X | | X |
| 10 | | X | | | X | | | | X | | | X | | |
| 11 | | | | | X | | X | | | | | X | | X |
| 12 | X | X | X | X | X | | X | | X | X | X | X | X | X |
| 13 | X | | X | | X | | X | | | X | | X | | X |
| 14 | | | X | | | | X | | | X | | | | X |
| 15 | | | X | | X | | | | | X | | X | | |
| 16 | X | | X | | X | | X | X | | X | | X | X | X |
| 17 | X | | | | X | | | X | | | | X | | |
| 18 | X | | X | | | | | X | | X | | | | |
| 19 | X | | X | | X | X | X | X | X | X | X | X | X | X |
| 20 | X | | X | | | X | | X | | X | X | | X | |
| 21 | | | X | | | X | | | | X | | | X | |
| 22 | X | | | | | X | | X | | | | | X | |
| 23 | X | | X | X | | X | | X | X | X | X | | X | |
| 24 | X | | | X | | | | X | | | X | | | |
| 25 | | | | X | | X | | | | | X | | X | |
| 26 | X | X | X | X | X | X | X | X | X | X | X | | X | |
| 27 | X | X | | X | | X | X | | X | | X | | X | |
| 28 | | X | | | | X | | | X | | | | X | |
| 29 | | X | | X | | | | | X | | X | | | |
| 30 | | X | | X | X | X | X | | X | | X | | X | X |
| 31 | | | | X | | | X | | | | X | | | X |
| 32 | | X | | | | | X | | X | | | | | X |
| 33 | X | X | X | X | X | X | X | | X | | X | X | X | X |
| 34 | | X | X | X | X | | X | | X | | | X | | X |
| 35 | | X | | | X | | | | X | | | X | | |
| 36 | | | | | X | | X | | | | | X | | X |
| 37 | X | X | X | | X | | X | | X | X | | X | | X |
| 38 | | | X | | | | X | | | X | | | | X |
| 39 | | | X | | X | | | | | X | | X | | |
| 30 | X | X | X | | X | | X | X | X | X | X | X | X | X |
| 41 | X | | X | | X | | | X | | X | | X | X | |
| 42 | X | | | | X | | | X | | | | X | | |
| 43 | X | | X | | | | | X | | X | | | | |
| 44 | X | | X | | X | X | | X | | X | X | X | X | |
| 45 | | | X | | | X | | | | X | | | X | |
| 46 | X | | | | | X | | X | | | | | X | |
| 47 | X | | X | X | X | X | X | X | X | X | X | X | | |
| 48 | X | | | X | | X | | X | X | | X | | X | |
| 49 | X | | | X | | | | X | | | X | | | |
| | 01 | 02 | 03 | 04 | 05 | 06 | 07 | 08 | 09 | 10 | 11 | 12 | 13 | 14 |

FIG.3

THREE LAYER PAPER MAKING DRAINAGE FABRIC

CROSS REFERENCES TO RELATED APPLICATIONS

This application is a national phase application of PCT/AT/00060 filed Apr. 23, 1991 and based upon an Austrian Application A1037/90 filed May 8, 1990 under the International Convention.

1. Field of the Invention

The invention relates to a fabric of synthetic monofilaments for use as a drain web in a paper machine, more particularly the invention relates to a paper making screen having warp threads and three layers of weft threads connecting these warp threads.

2. Background of the Invention

In order to increase the wear toleration of a paper-making screen or feet, fabrics with a higher number of healds were constructed; this increases the floating length of the weft threads on the operating side while largely maintaining the visual aspect of the surface geometry on the paper side. Thus, a relatively greater proportion of the length of the operating-side weft threads is available for abrasion.

Problems with this construction arise because the weft threads, floating over longer stretches, cause a pronounced marking of the papers, especially in the case of fast-running machines, as a result of turbulence created when the wire moves over stationary draining elements, such as foils, wet suction boxes or other suction boxes.

DE-A-2 445 185 describes a three-layer fabric corresponding to the above-mentioned type. Two adjoining layers each, tied by their respective warp threads, are connected by means of separate strings.

The strings are formed as warp threads connecting two layers in such a manner that in the finished wire the surface of the top layer is not absolutely planar so that the different levels of the surface result in a high degree of wire markings on the paper.

U.S. Pat. No. 4,941,514 describes a four-layer fabric in which the weft threads are tied by warp threads extending through all layers. In this known fabric, permeability is reduced at the center of the fabric because the apertures between the fabric elements are smaller. The draining capacity of the fabric is thus diminished. This is even more compounded by the fact that fibers which penetrate the fabric due to the larger apertures existing on the paper side of the fabric clog the smaller apertures at the center of the fabric even more strongly.

OBJECTS OF THE INVENTION

It is the object of the present invention to prevent markings and to use wires equipped with weft threads of extended floating ability on the operating side even in fast machines running at velocities of more than 400 m/min. Still another object is to improve the drainage capacity as much as possible.

Yet another object of the present invention is to accentuate the curve of the bottom weft layer toward the operating side so that more volume of the bottom weft thread can be abraded on the operating side.

SUMMARY OF THE INVENTION

This is achieved by having the weft threads, which are tied in groups, being connected both by warp threads running only through the two top layers and warp threads running through all three layers.

The thus tied middle weft layer creates a wider space between the mat surface and the stationary carrying elements of the paper machine so that the turbulence effects of the bottom weft threads, which float for longer stretches, do not reflect on the mat.

The wider space disturbs the turbulences and damps their effect on the mat. This phenomenon is due to the unobstructed space of the wire construction, which narrows upward in a vertical direction. Practically markings not observed. As a result of the unobstructed space narrowing upward in a vertical direction, the drainage effect is not impaired.

In a fabric according to the invention, every weft thread of the bottom layer is grasped by two, preferably not adjoining, warp threads from below and pulled upward towards the warp threads located between the weft threads of the middle layer which acts as a support so that the curve facing the outside of the wire can e maximally developed.

In a preferred embodiment of the invention, four weft threads of the top layer combine with two weft threads of the middle layer and one weft thread of the bottom layer to form a group, in which, out of two adjoining warp threads, one thread weaves two of the weft threads of the top layer from above, one from below and two from above. It then passes the middle layer and subsequently the weft thread of the bottom layer of the third group below. After half of the pattern repeat has been completed, it again binds the top layer as before, passes the middle layer and binds the bottom weft thread of the seventh group, while the second warp threads bind the top layer, staggered as repeats increase, but then run parallel below the weft threads of the middle layer in the second half of the repeat.

The degree to which the unobstructed space narrows down between the threads of the individual weft layers can be described by the value $A=10$ (number of wefts per cm$\times$weft diameter in mm) and equals the unobstructed space between the weft threads given a ire length of 10 mm. This value should equal 3.2 to 4.5 in the top layer, 5.1 to 5.2 in the middle layer and 6.2 to 7 in the bottom layer.

It is advisable to have 14 or 16 healds.

BRIEF DESCRIPTION OF DRAWING

The above and other objects, features and advantages will become more readily apparent from the following references being made to drawing:

FIG. 3 is the weave pattern of a 14-heald fabric according to the invention.

SPECIFIC DESCRIPTION

Figure 1:
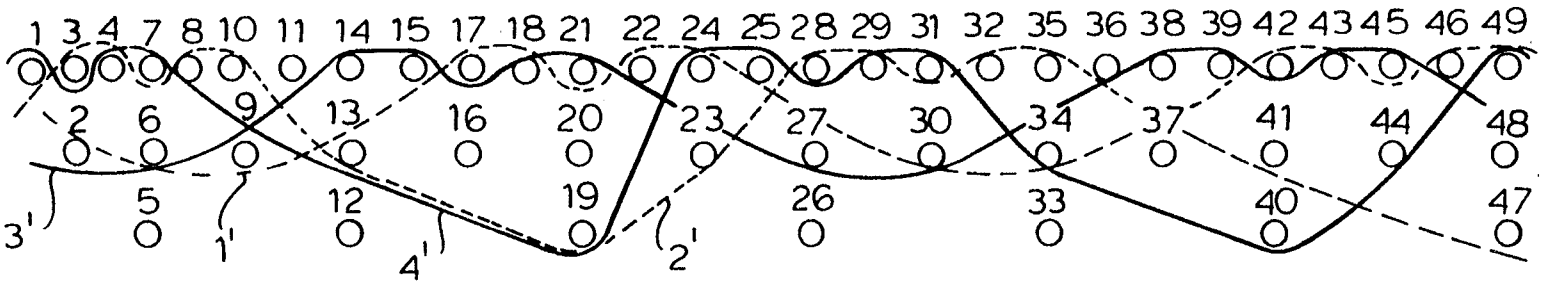
FIG. 1 is a section of a fabric running parallel to the warp.

According to FIG. 1, of the weft threads No. 1, 3, 4, 8, 10 etc. of the top layer, each two correspond to one weft thread of the middle layer 2, 6, 9, 13 etc. Each two weft threads of the middle layer then correspond to one weft thread of the bottom layer 5, 12, 19 etc. Four weft threads of the top layer, two of the middle layer and one of the bottom layer form a weft group.

Figure 2:
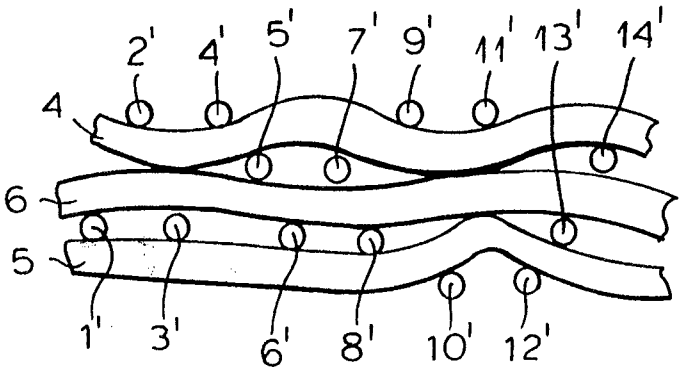
FIG. 2 is a section of the fabric running parallel to the weft of the fabric.

The warp threads 2', 4', 6', 8' etc. are arranged in such a way that they tie the weft threads of the top layer in a pattern of 2/1/2, then pass through the middle layer and tie the weft of the bottom layer before moving upward again. This process is once repeated in the pattern repeat. Another group of warp threads 1', 3', 5', 7' etc. runs parallel to 2', 4', 6' etc. of the top layer. However, in the middle layer it runs below the weft threads without tying a thread of the bottom group. The next warp thread of the first group 4' (after 2') runs in such a way that it ties the same weft thread 19 in the bottom layer. However, as the second weft thread, this warp thread 40 of the bottom layer. Thus, each weft thread of the bottom layer is tied by two warp threads. As the wave cross-section (FIG. 2) shows, the warp threads 1', 3', 6', 8' and 13' are located between the weft thread of the bottom layer 5 and the middle layer 6; they deform the curve of the weft thread 5 towards the operating side during weaving, and even more during wire thermofixing, towards the outside.

For this reason, those warp threads that run between the middle and bottom weft layers (1', 3', 6', 8', 13' in FIG. 2) create points of support for the bottom weft which contribute producing a more pronounced curve of the bottom weft thread towards the operating side; this also increases the abrasion capacity of the wire because a greater volume of the bottom weft thread can be abraded before the warp threads are abraded in their turn on the operating side. The warp threads 1', 3', 6', 8', 13', running in the space between the middle and bottom weft layers, are spaced as evenly as possible between the tying points of the bottom weft (10', 12'). Moreover, the material of the middle weft thread is selected to guarantee that it will be deformed as little as possible and remain rigid during the weaving and thermofixing processes.

The table contains a summary of warp thread numbers and diameters as allocated to the thread numbers and diameters of the three weft layers, which leads to a steady narrowing of the free space between the weft threads from the operating side towards the paper side; this produces the damping effect of the individual weft layers.

TABLE 1

| Number of warp threads ($cm^{-1}$) Diameter of warp threads | Number of weft - threads ($cm^{-1}$) | Diameter of weft threads (mm) | Coefficient A 10 − No. wefts × diameter wefts |
|---|---|---|---|
| 70/cm | 44/cm | 0.15 | 3.4 top layer |
| 0.15 | 22/cm | 0.20 | 5.16 middle layer |
| | 11/cm | 0.35 | 6.15 bottom layer |
| 60/cm | 38/cm | 0.17 | 3.54 top layer |
| 0.17 | 19/cm | 0.22 | 5.82 middle layer |
| | 9.5/cm | 0.40 | 6.20 bottom layer |
| 56/cm | 34/cm | 0.20 | 3.20 top layer |
| 0.20 | 17/cm | 0.25 | 5.75 middle layer |
| | 8.5/cm | 0.45 | 6.18 bottom layer |
| 44/cm | 28/cm | 0.23 | 3.56 top layer |
| 0.23 | 14/cm | 0.32 | 5.52 middle layer |
| | 7/cm | 0.50 | 6.50 bottom layer |
| 36/cm | 22/cm | 0.25 | 4.50 top layer |
| 0.25 | 11/cm | 0.45 | 5.10 middle layer |
| | 5.5/cm | 0.55 | 6.98 bottom layer |

I claim:

1. A drainage fabric for a papermaking machine, comprising:

a warp consisting of a multiplicity of synthetic monofilament warp threads; and a weft interwoven with said warp and consisting of a top layer of weft threads, a middle layer of weft threads and a bottom layer of weft threads, said warp threads tying said weft threads in groups and including a set of warp threads running only through said top and middle layers of weft threads and other warp threads running through all of said top, middle and bottom layers, each weft thread of said bottom layer being engaged by two nonadjacent warp threads from below and pulled upwardly toward warp threads of said set of warp threads located between weft threads of said middle layer and said bottom layer and acting as a support for the weft threads of said bottom layer which are pulled upwardly.

2. The drainage fabric defined in claim 1 wherein said weft threads of said middle layer are composed of high molecular weight polyester with an elongation to break of less than 30% and a polymer viscosity index in excess of 0.90.

3. A drainage fabric for a papermaking machine, comprising:

a warp consisting of a multiplicity of synthetic monofilament warp threads; and a weft interwoven with said warp and consisting of a top layer of weft threads, a middle layer of weft threads and a bottom layer of weft threads, said warp threads tying said weft threads in groups and including a set of warp threads running only through said top and middle layers of weft threads and other warp threads running through all of said top, middle and bottom layers:

each group comprising four of said weft threads of said top layer, two of said weft threads of said middle layer and one of said weft threads of said bottom layer;

of each two adjacent warp threads of said warp, one of the two adjacent warp threads is woven around two of said weft threads of said top layer from above, one of said weft threads of said top layer from below, and two of said weft threads of said top layer from above, in succession;

said one of the two adjacent warp threads then passes through the middle layer and around a weft thread of said bottom layer from below in a group spaced by two of said groups from a group containing a last weft thread of the top layer about which said one of the two adjacent warp threads is woven from above prior to passing through the middle layer; and the other of the two adjacent warp threads being woven over another two weft threads of said top layer, under a weft thread of said top layer and over another two weft threads of said top layer in succession and then passing parallel below a plurality of weft threads of said middle layer.

4. A drainage fabric for a papermaking machine, comprising:

a warp consisting of a multiplicity of synthetic monofilament warp threads; and a weft interwoven with said warp and consisting of a top layer of weft threads, a middle layer of weft threads and a bottom layer of weft threads, said warp threads tying said weft threads in groups and including a set of warp threads running only through said top and middle layers of weft threads and other warp threads running through all of said top, middle and bottom layers, said top layer has a value A of 3.2 to 4.5, said middle layer having a value A of 5.1 to 5.2 and said bottom layer has a value A of 6.2 to 7, where A=10—(a number of weft threads per cm×weft diameter in mm).

* * * * *